US009406284B2

(12) United States Patent
Yoshizaki

(10) Patent No.: US 9,406,284 B2
(45) Date of Patent: Aug. 2, 2016

(54) KEYBOARD DEVICE AND KEY UNIT

(71) Applicant: YAMAHA CORPORATION, Hamamatsu-shi, Shizuoka-ken (JP)

(72) Inventor: Yu Yoshizaki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/937,225

(22) Filed: Nov. 10, 2015

(65) Prior Publication Data

US 2016/0133234 A1 May 12, 2016

(30) Foreign Application Priority Data

Nov. 10, 2014 (JP) ..... 2014-227870
Mar. 13, 2015 (JP) ..... 2015-050746

(51) Int. Cl.
*G10C 3/12* (2006.01)

(52) U.S. Cl.
CPC ..... *G10C 3/12* (2013.01)

(58) Field of Classification Search
CPC ..... G10C 3/12
See application file for complete search history.

(56) References Cited

U.S. PATENT DOCUMENTS 4,914,999 A * 4/1990 Masubuchi ..... G10C 3/12 200/5 A
6,002,078 A * 12/1999 Yoshinaga ..... G10H 1/344 84/423 R
6,369,309 B1 * 4/2002 Nishida ..... G10C 3/12 84/423 R
7,332,663 B2 * 2/2008 Nishida ..... G10C 3/12 84/423 R
7,465,863 B2 * 12/2008 Nishida ..... G10C 3/12 84/423 R
7,683,247 B2 * 3/2010 Nishida ..... G10H 1/346 84/423 R

FOREIGN PATENT DOCUMENTS

JP 2002062876 A 2/2002
JP 2005092233 A 4/2005

* cited by examiner

*Primary Examiner* — Robert W Horn
(74) *Attorney, Agent, or Firm* — Rossi, Kimms & McDowell LLP

(57) ABSTRACT

A keyboard device includes key units each including keys arranged in a right and left direction, hinges, a common mounting portion which are molded in one piece. The common mounting portion is elongated in the right and left direction. Bach hinge is provided between the common mounting portion and the key. The key units include a particular key unit having an uppermost one of the common mounting portions. At least one of the hinges of the particular key unit includes a hinge thick portion connected to a rear surface of the key; and a hinge thin portion connected to a rear surface of the hinge thick portion and connected to a front surface of the uppermost common mounting portion. A protrusion protruding outward is provided on at least one of opposite outer ends of the hinge thick portion in the right and left direction.

16 Claims, 6 Drawing Sheets

KEYBOARD DEVICE AND KEY UNIT

CROSS REFERENCE TO RELATED APPLICATION

The present application claims priority from Japanese Patent Application Nos. 2014-227870 filed on Nov. 10, 2014, and 2015-050746 filed on Mar. 13, 2015, the contents of which are herein incorporated by reference.

BACKGROUND

1. Technical Field

The following disclosure relates to: a keyboard device including a plurality of key units superposed on and secured to one another on a key frame and each including (i) a common mounting portion elongated in a right and left direction and (ii) a plurality of keys having rear ends connected to the common mounting portion; and the key unit.

2. Description of the Related Art

There has been known a keyboard device including a plurality of key units assembled to a key frame and each formed of resin in one piece. Each of the plurality of key units includes a plurality of keys extending in a front and rear direction and arranged next to each other in a right and left direction; a common mounting portion; a plurality of hinges each shaped like a flat plate and provided between the common mounting portion and rear ends of the respective keys in a state in which upper surfaces of the respective hinges are horizontal. Patent Document 1 (Japanese Patent Application Publication No. 2002-62876) and Patent Document 2 (Japanese Patent Application Publication No. 2005-92233) disclose keyboard devices each including: a first key unit including a plurality of white keys respectively corresponding to notes D, F, and A; a second key unit including a plurality of white keys respectively corresponding to notes C, E, and B; and a third key unit including a plurality of black keys respectively corresponding to notes C#, D#, F#, G#, and A#. The first through third key units are superposed on each other in this order at their respective common mounting portions and placed on and secured to a rear end portion of a key frame by male screws.

In each of the first through third key units, each hinge includes: a hinge thick portion which is elastically deformed by a small amount when a corresponding white or black key is depressed and released; and hinge thin portions which are elastically deformed by a large amount, when a corresponding white or black key is depressed and released, so as to allow pivotal movement of a front end portion of the key in an up and down direction. A front end of the hinge thick portion is integrally connected to a rear surface of the corresponding key, and front ends of the respective hinge thin portions are connected to a rear end of the hinge thick portion, and rear ends of the respective hinge thin portions are connected to a front surface of the common mounting portion. In particular, in the third key unit including the black keys and located at the uppermost position among the first through third key units, the width of each hinge thick portion in the right and left direction is greater than that of a rear end of the corresponding black key in the right and left direction. Furthermore, in the third key unit, the pair of hinge thin portions having the same width in the right and left direction are spaced apart from each other in, the right and left direction and extend rearward from rear surfaces of respective opposite end portions of the hinge thick portion in the right and left direction. For each key of the third key unit, a right outer end of the hinge thick portion and a right outer end of a right one of the pair of hinge thin portions are located at the same position in the right and left direction, and a left outer end of the hinge thick portion and a left outer end of a left one of the pair of hinge thin portions are located at the same position in the right and left direction. Furthermore, an extremely small clearance is formed between the hinge thick portions for adjacent two of the black keys.

SUMMARY

In the above-described keyboard device, the extremely small clearance is merely formed between the adjacent hinge thick portions of the black keys in a state in which an upper cover covers a space formed behind positions located slightly at the rear of the respective rear ends of the white keys and the black keys. Thus, the hinge thick portions of the first and second key units including the white keys are not inconspicuous when viewed from above, resulting in good external appearance.

However, the pair of hinge thin portions are respectively located at opposite outer end portions of the hinge thick portion, and the plurality of black keys are arranged at different distances in the right and left direction. Thus, positions of the pair of hinge thin portions with respect to the corresponding black key in the right and left direction vary among the black keys, and the pair of hinge thin portions are not symmetric with respect to a center line of the corresponding black key in the right and left direction. As a result, variations may be caused, in stiffness (elasticity) of the hinge thin portions and the hinge thick portion in the right and left direction, between the black keys and between portions of each of the black keys in the right and left direction. In particular, this phenomenon occurs remarkably in the case where the length of the hinge thick portion is small in the front and rear direction and/or in the case where the lengths of the hinge thick portions in the right and left direction greatly differ from each other. As a result, key touch feelings during depression and release of the key may vary among the plurality of black keys, unfortunately. Also, an imbalance may be caused in each black key in the right and left direction, leading to deterioration of key touch feelings. Furthermore, this imbalance may cause twists in the hinge thin portions and the hinge thick portion, leading to deterioration of durability of the hinge.

Accordingly, an aspect of the disclosure relates to a keyboard device and a key unit with good external appearance and improved key touch feelings.

In one aspect of the disclosure, a keyboard device includes: a plurality of key units each including a plurality of keys, a plurality of hinges, a common mounting portion which are molded in one piece, a plurality of the common mounting portions of the plurality of key units being superposed on each other and secured to a key frame. The plurality of keys are arranged in a right and left direction and each extends in a front and rear direction. The common mounting portion is elongated in the right and left direction. Each of the plurality of hinges is provided between the common mounting portion and a rear end of a corresponding one of the plurality of keys and has a planar plate shape in which a plate surface of each of the plurality of hinges is substantially horizontal. The plurality of key units include a particular key unit including an uppermost common mounting portion of the plurality of the common mounting portions. Each of at least one of the plurality of hinges of the particular key unit includes: a hinge thick portion connected to a rear surface of a corresponding one of the plurality of keys; and a hinge thin portion connected to a rear surface of the hinge thick portion and connected to a front surface of the uppermost common mounting portion, the hinge thin portion being less in thickness than the hinge thick portion in an up and down direction. A protrusion protruding outward is provided on at least one of opposite outer ends of the hinge thick portion in the right and left direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
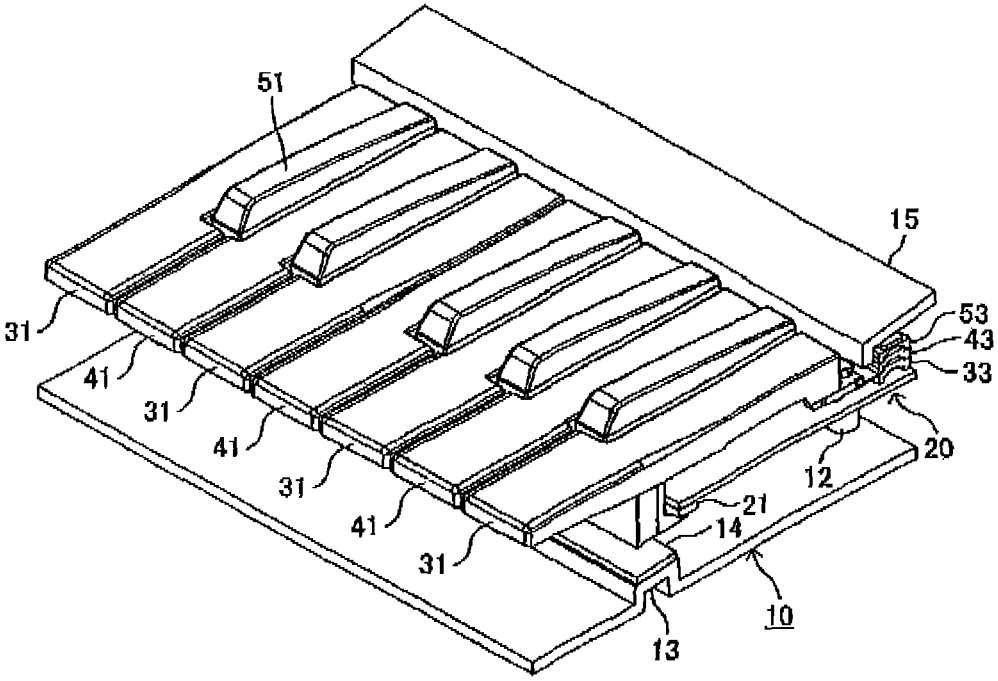
FIG. 1 is a perspective view generally illustrating a keyboard device including keys corresponding to one octave, according to one embodiment.
Figure 2:
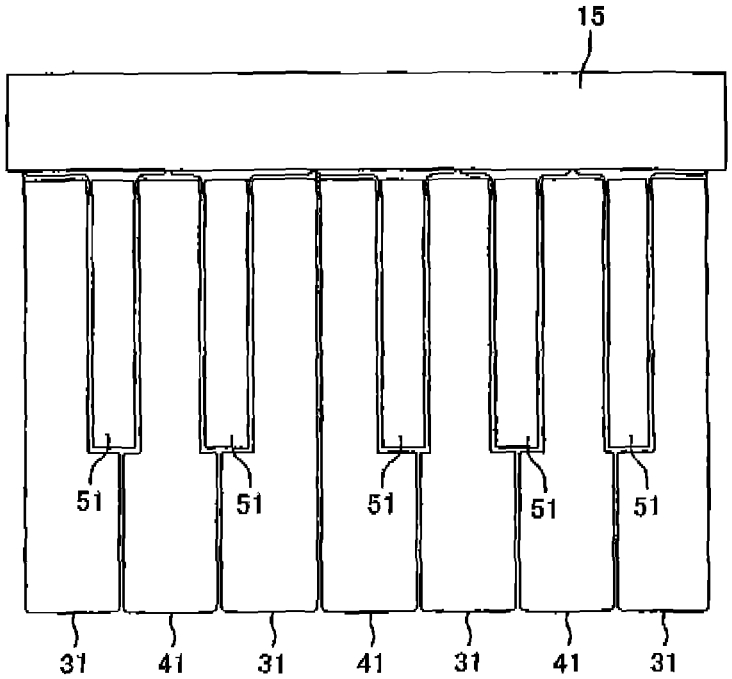
FIG. 2 is a plan view of the keyboard device in FIG. 1.
Figure 3A:
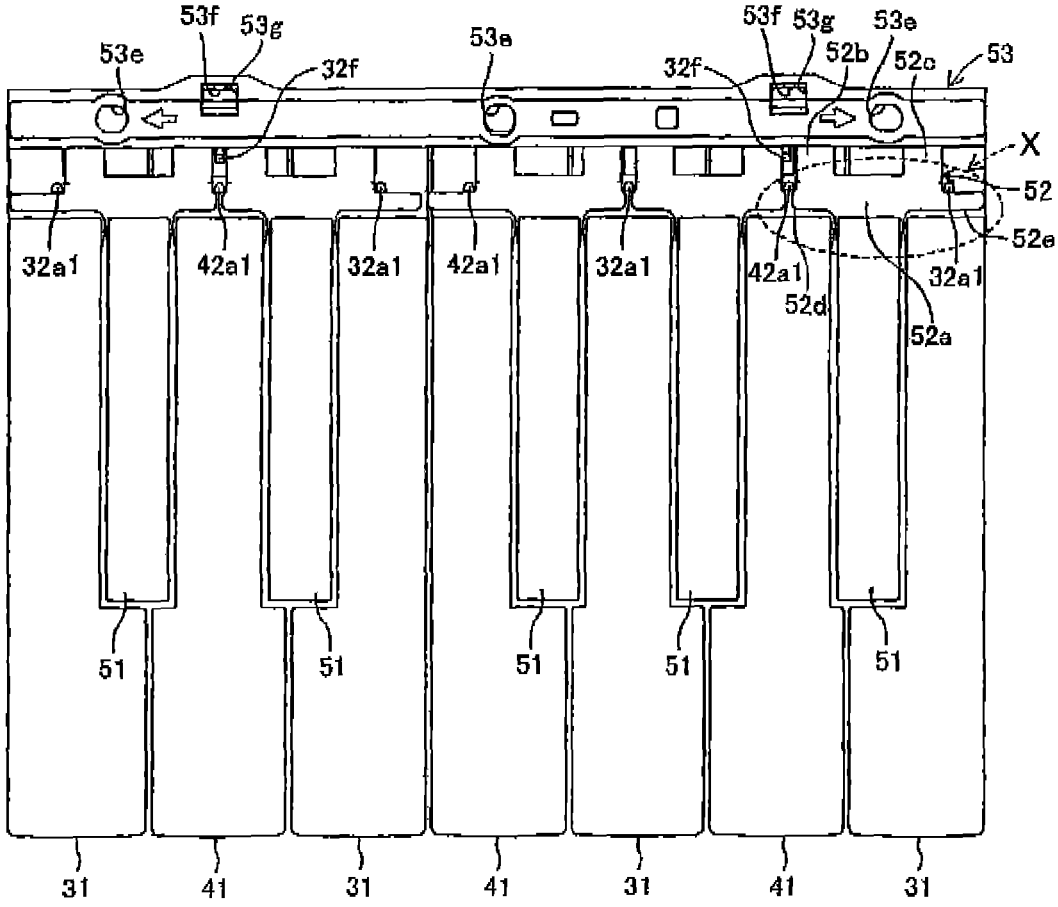
FIG. 3A is a plan view of the keyboard device, with an upper cover removed from the keyboard device in FIG. 1.
Figure 3B:
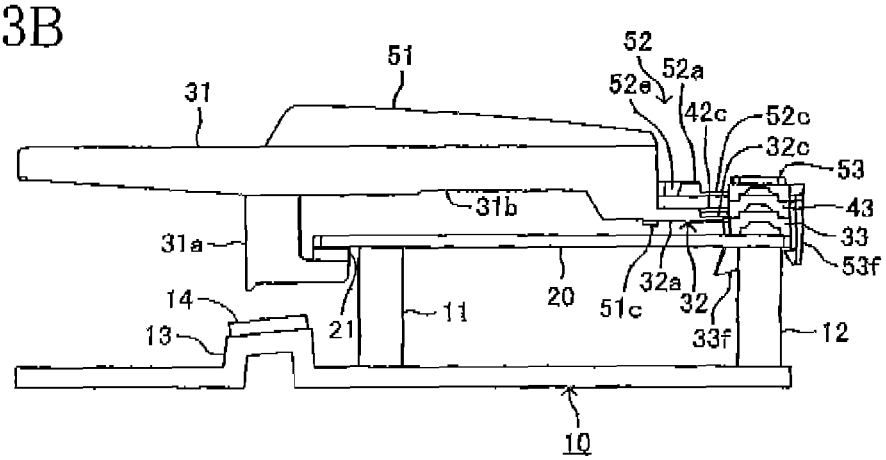
FIG. 3B is a side view of the keyboard device in FIG. 3A.

Hereinafter, there will be described one embodiment by reference to the drawings. FIG. 1 is a perspective view generally illustrating a keyboard device including keys corresponding to one octave, according to one embodiment. FIG. 2 is a plan view of the keyboard device. FIG. 3A is a plan view of the keyboard device, with an upper cover removed from the keyboard device, and FIG. 3B is a side view of the keyboard device in FIG. 3A. In the following description, a player side (the lower left side in FIG. 1 and the lower side in FIG. 2) is defined as a front side of the keyboard device, and an opposite side (the upper right side in FIG. 1 and the upper side in FIG. 2) of the keyboard device from the player side is defined as a rear side of the keyboard device. The right and left direction with respect to the player (the direction directed from the upper left side toward the lower right side in FIG. 1, and the right and left direction in FIG. 2) is defined as the right and left direction with respect to the keyboard device. It is noted that the following explanation will be provided for construction corresponding one octave for simplicity.

The keyboard device includes a keyboard and a key frame 10 disposed under the keyboard and fixed in a keyboard instrument. The key frame 10 is formed of a material such as metal or resin in one piece so as to have a planar plate shape extending horizontally in the right and left direction and the front and rear direction. A plurality of supports 11 are provided on an intermediate portion of the key frame 10 in the front and rear direction, and a plurality of supports 12 are provided on a rear end portion of the key frame 10 in the front and rear direction. In the present embodiment, the three supports 11 are provided respectively at opposite end portions and an intermediate portion in the right and left direction, and likewise the three supports 12 are provided respectively at opposite end portions and an intermediate portion in the right and left direction. Each of the supports 11, 12 has a circular cylindrical shape and is formed integrally with the key frame 10. Each of the supports 11, 12 protrudes upward from an upper surface of the key frame 10. An electric circuit board 20 is placed on and secured to upper surfaces of the supports 11, 12 respectively by male screws, not shown. In addition to the electric circuit board 20, first through third key units 30, 40, 50 which will be described below in detail are also placed on and secured to the upper surfaces of the respective supports 12 respectively by male screws, not shown. Each of the supports 11, 12 has a screw hole which extends downward from its upper surface. Front and rear end portions of the electric circuit board 20 have through holes, not shown, into which the respective male screws are inserted. These through holes are formed respectively at positions corresponding to the supports 11, 12 in the right and left direction.

The electric circuit board 20 is formed of a material such as resin in one piece so as to have a planar plate shape. Key switches (e.g., rubber dome switches), not shown, electric circuit components and other similar components are disposed on an upper surface of the electric circuit board 20. It is noted that the electric circuit components may be disposed on a lower surface of the electric circuit board 20. In order to reduce a degree of contact or collision between white keys 31, 41 and black keys 51, a cushioning material 21, such as felt, elongated in the right and left direction is affixed to a lower surface of a front end portion of the electric circuit board 20 which is located in front of the support 11. The electric circuit board 20 and the cushioning material 21 limit upward movement of a front end portion of each of the white keys 31, 41 and the black keys 51 when each of the white keys 31, 41 and the black keys 51 is released.

The key frame 10 is provided with a lowerlimit stopper 13 at a position located slightly in front of the supports 11. This lowerlimit stopper 13 limits downward movement of the front end portion of each of the white keys 31, 41 and the black keys 51 when each of the white keys 31, 41 and the black keys 51 is depressed. The lowerlimit stopper 13 extends in the right and left direction so as to be formed integrally with the key frame 10. When viewed in the right and left direction, this lowerlimit stopper 13 protrudes upward so as to have a three-sided rectangular shape opening downward, and a front end portion of the lowerlimit stopper 13 is slightly lower in height than a rear end portion of the lowerlimit stopper 13. In order to reduce a degree of contact or collision between the white keys 31, 41 and the black keys 51, a cushioning material 14, such as felt, elongated in the right and left direction is affixed to an upper surface of the lowerlimit stopper 13. An upper cover 15 extending in the right and left direction is provided over the rear end portion of the key frame 10. For good external appearance, the upper cover 15 covers rear end portions of the respective first through third key units 30, 40, 50 (noted that the rear end portions are located slightly at the rear of respective rear ends of the white keys 31, 41 and the black keys 51.

Figure 4A:
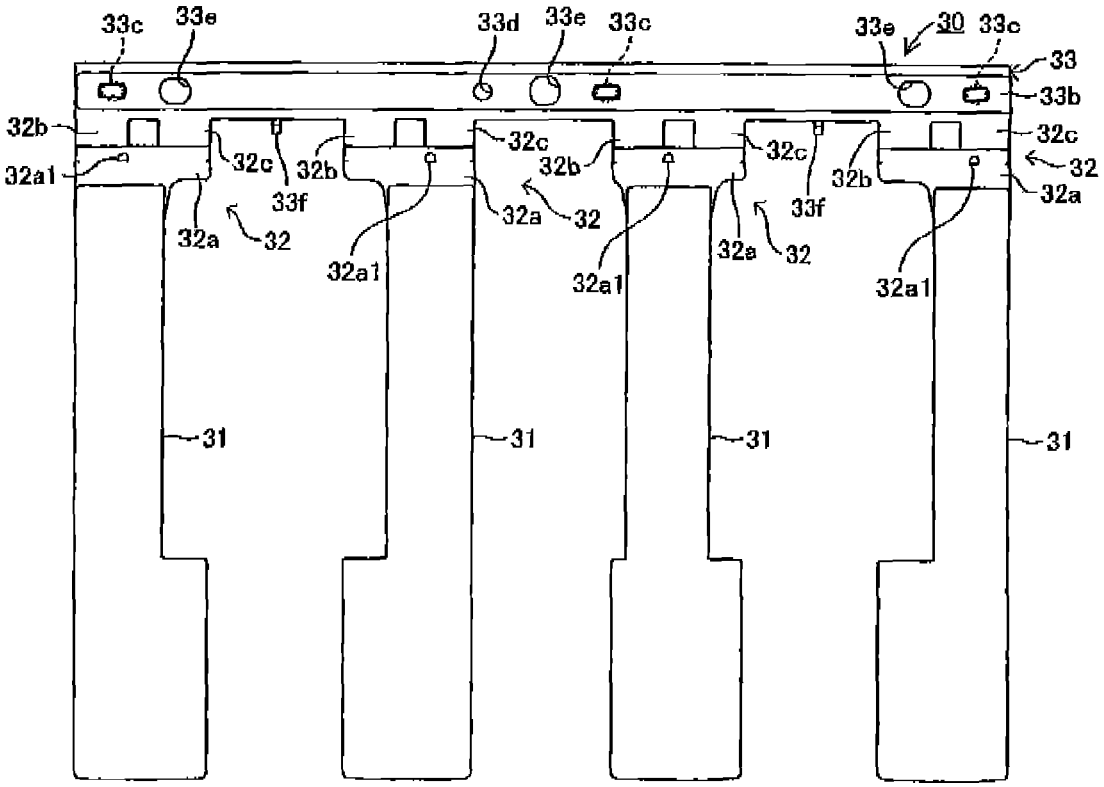
FIG. 4A is a plan view of a first key unit of the keyboard device in FIGS. 1 through 3B.
Figure 4B:
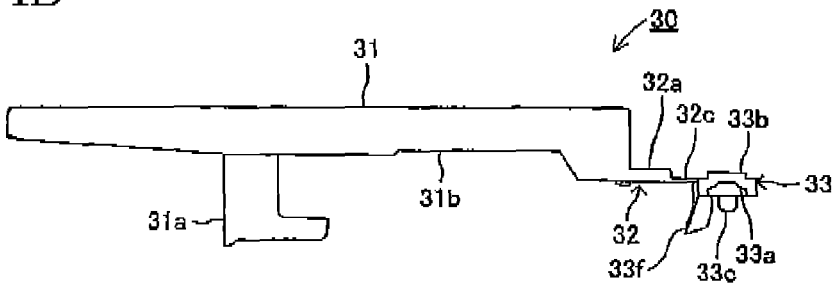
FIG. 4B is a side view of the first key unit.

There will be next explained the first key unit 30 with reference to FIGS. 4A and 4B. FIG. 4A is a plan view of the first key unit 30, and FIG. 4B is a side view thereof. The first key unit 30 includes the four white keys 31 not next (adjacent) to each other and respectively corresponding to notes C, E, G, and B. Each of the white keys 31 is constituted by an upper plate, a front wall, right and left side walls, and a rear wall, which define a space opening downward and having a rectangular shape in cross section. The upper plate and the right and left side walls have one or two inside corner portions (step portions) each for arrangement of a corresponding one of black keys 51.

Each of the white keys 31 is provided with an engaging piece 31*a* which is formed integrally with a lower surface of the white key 31 at its intermediate position in the front and rear direction. The engaging piece 31*a* extends downward and has a protrusion protruding rearward at a lower end portion of the engaging piece 31*a*. When the white key 31 is depressed, a lower surface of the engaging piece 31*a* is brought into contact with the cushioning material 14 to limit downward movement of a front end of the white key 31. When the white key is released, the protrusion of the engaging piece 31*a* is brought into contact with the cushioning material 21 at an upper surface of the protrusion to limit upward movement of the front end of the white key 31. The lower surface of the white key 31 has a pressing portion 31*b* which is located at an intermediate position on the lower surface of the white key 31 in the front and rear direction and at a position opposed to a corresponding one of the key switches provided on the electric circuit board 20. The pressing portion 31*b* presses a corresponding one of the key switches when the white key 31 is depressed.

The rear walls of the respective four white keys 31 are connected to a common mounting portion (a rail portion) 33 via respective hinges 32. The hinges 32 and the common mounting portion 33 are molded integrally with the white keys 21. Each of the hinges 32 is constituted by a hinge thick portion 32*a* and a pair of hinge thin portions 32*b*, 32*c*. The hinge thick portion 32*a* is connected at its front end to a lower end portion of a rear surface of the rear wall of a corresponding one of the white keys 31. The hinge thick portion 32*a* has a relatively large thickness in the up and down direction and is shaped like a planar plate having a substantially rectangular shape elongated in the right and left direction. With this construction, an amount of elastic deformation of the hinge thick portion 32*a* is small in the up and down direction. The center position of the hinge thick portion 32*a* in the right and left direction is aligned with that of the front end portion of the white key 31 in the right and left direction. The width of the hinge thick portion 32*a* in the tight and left direction is generally equal to that of the front end portion of the white key 31 in the right and left direction (strictly, the width of the hinge thick portion 32*a* in the right and left direction is extremely slightly greater than that of the front end portion of the white key 31 in the right and left direction). Opposite ends of the hinge thick portion 32*a* in the right and left direction are substantially aligned in position respectively with opposite ends of the front end portion of the white key 31 in the right and left direction. Each of hinge thick portions 32*a* has a gate corresponding portion 32*a*1 in its upper surface at a substantially central position of a rear end portion of the corresponding white key 31 in the right and left direction. The gate corresponding portion 32*a*1 is a gate from which resin is injected when the first key unit 30 is molded in one piece.

Each of the hinge thin portions 32*b*, 32*c* is connected at its front end to a lower end portion of a rear surface of a corresponding one of opposite outer end portions of the hinge thick portion 32*a* in the right and left direction. Each of the hinge thin portions 32*b*, 32*c* is thinner than the hinge thick portion 32*a* in the up and down direction and is shaped like a planar plate having a rectangular shape in which its length in the right and left direction is slightly greater than that in the front and rear direction. With this construction, an amount of elastic deformation of each of the hinge thin portions 32*b*, 32*c* is large in the up and down direction. A left end of the hinge thin portion 32*b* is substantially aligned in position with a left end of the front end portion of the white key 31 (and a left end of the hinge thick portion 32*a*). A right end of the hinge thin portion 32*b* is located to the left of the center of the front end portion of the white key 31 in the right and left direction by a corresponding predetermined distance. A right end of the hinge thin portion 32*c* is substantially aligned in position with a right end of the front end portion of the white key 31 (and a right end of the hinge thick portion 32*a*). A left end of the hinge thin portion 32*c* is located to the right of the center of the front end portion of the white key 31 in the right and left direction by a corresponding predetermined distance. That is, the hinge thin portions 32*b*, 32*c* are spaced apart from each other by a predetermined distance so as to be symmetric with respect to the center line of the front end portion of the white key 31 in the right and left direction. In terms of a positional relationship between the hinge thick portion 32*a* and each of the hinge thin portions 32*b*, 32*c*, the hinge thin portions 32*b*, 32*c* are preferably provided at such positions that lateral stiffness of the hinge thin portions 32*b*, 32*c* and the hinge thick portion 32*a* is appropriate (for example, the stiffness is the greatest), in accordance with the length of the hinge thick portion 32*a* in the front and rear direction.

The common mounting portion 33 is elongated in the right and left direction and has a substantially rectangular shape in vertical cross section in the front and rear direction. Rear ends of the respective hinge thin portions 32*b*, 32*c* are connected to an upper portion of a front surface of this common mounting portion 33. The common mounting portion 33 includes: a recessed portion 33*a* formed in a lower surface of the common mounting portion 33 so as to extend in the right and left direction; and a protruding portion. 33*b* formed on an upper surface of the common mounting portion 33 so as to extend in the right and left direction. Protrusions 33*c* extending downward are provided on the lower surface of the common mounting portion 33 at positions spaced apart from each other in the right and left direction. In the present embodiment, the protrusions 33*c* are respectively provided on opposite end portions and an intermediate portion of the lower surface of the common mounting portion 33 in the right and left direction. Each of the protrusions 33*c* is shaped like a circular cylinder whose lower end is chamfered. These protrusions 33*c* are pressed into holes, not shown, of the electric circuit board 20 when the common mounting portion 33 is assembled to the rear end portion of the electric circuit board 20. A through hole 33*d* is formed in the common mounting portion 33. In the present embodiment, the through hole 33*d* is formed at an intermediate portion of the common mounting portion 33 in the right and left direction. The through hole 33*d* has a round shape. A protrusion 43*c*, which will be described below, provided on the second key unit 40 is pressed into the through hole 33*d* when the second key unit 40 is assembled onto the first key unit 30. The common mounting portion 33 has through holes 33*e* spaced apart from each other in the right and left direction so as to correspond to the positions of the supports 12 of the key frame 10. Each of the through holes 33*e* has a round shape slightly larger in size than the through hole 33*d*. Male screws, not shown, are inserted through the respective through holes 33*e* when the first through third key units 30, 40, 50 are assembled to the key frame 10. Protruding pieces 33*f* extending downward are provided on the lower surface of the common mounting portion 33 at positions spaced apart from each other in the right and left direction. In the present embodiment, the two protruding pieces 33*f* are provided on an intermediate portion of the lower surface of the common mounting portion 33 in the right and left direction. When the common mounting portion 33 is assembled to the rear end portion of the electric circuit board 20, each of the protruding pieces 33*f* is inserted into a corresponding one of through holes, not shown, of the electric circuit board 20 with a clearance so as to function as a guide.

Figure 5A:
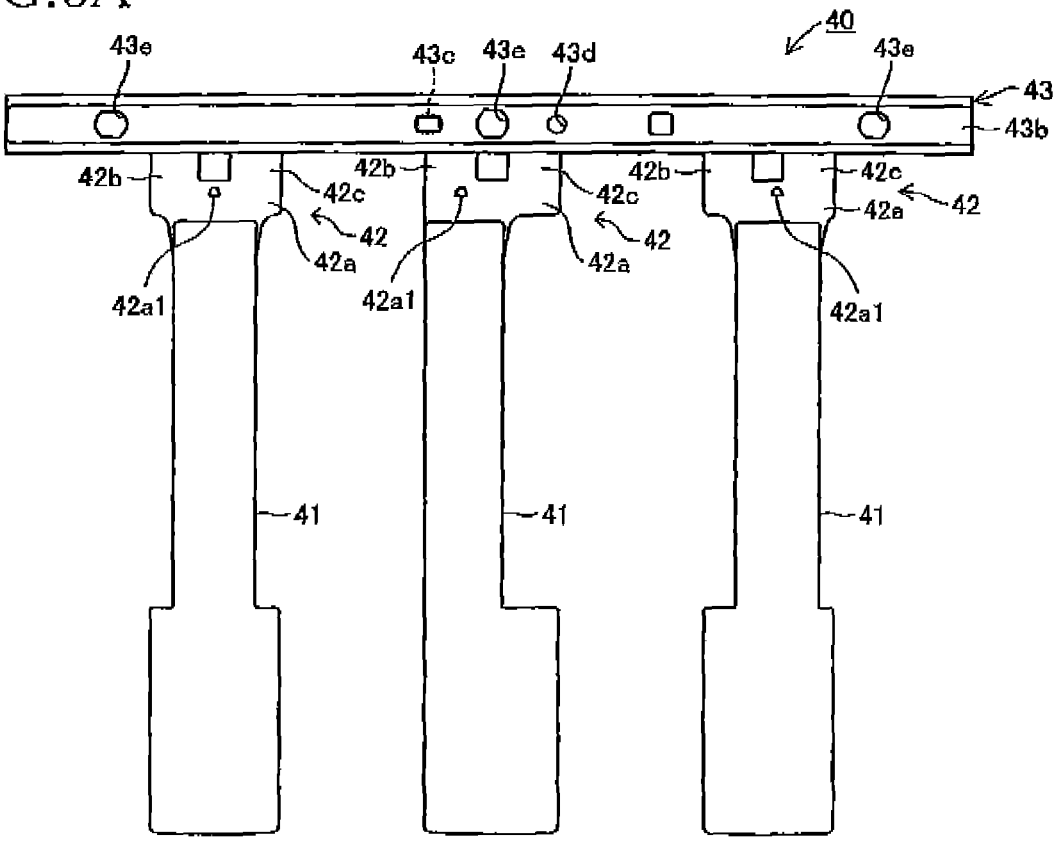
FIG. 5A is a plan view of a second key unit of the keyboard device in FIGS. 1 through 3B.
Figure 5B:
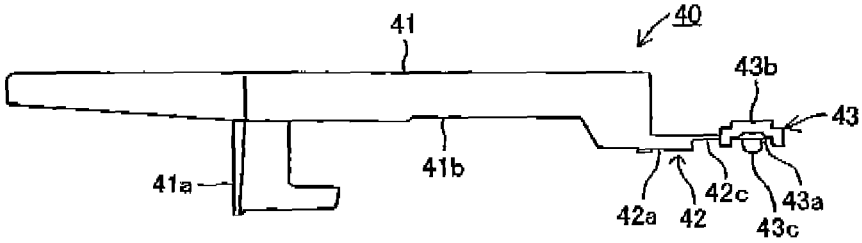
FIG. 5B is a side view of the second key unit.

There will be next explained the second key unit 40 with reference to FIGS. 5A and 5B. FIG. 5A is a plan view of the second key unit 40, and FIG. 5B is a side view thereof. The second key unit 40 includes the three white keys 41 not next (adjacent) to each other and respectively corresponding to notes D, F, and A. Each of the white keys 41 is constituted by an upper plate, a front wall, right and left side walls, and a rear wall, which define a space opening downward and having a rectangular shape in cross section. The length of each white key 41 in the front and rear direction and the height of each white key 41 are equal to those of each white key 31. The white key 41 differs from the white key 31 in inside corner portion or portions, provided on, the upper plate and the right and left side walls, each for arrangement of a corresponding one of black keys 51. An engaging piece 41*a* and a pressing portion 41*b* are provided on an intermediate position of a lower surface of the white key 41 in the front and rear direction. The engaging piece 41*a* and the pressing portion 41*b* are similar in construction to the engaging piece 31*a* and the pressing portion 31*b* of the white key 31, respectively.

The rear walls of the respective three white keys 41 are connected to a common mounting portion 43 via respective hinges 42. The hinges 42 and the common mounting portion 43 are molded integrally with the white keys 41. Each of the hinges 42 is constituted by a hinge thick portion 42*a* and a pair of hinge thin portions 42*b*, 42*c* which are similar in construction to the hinge thick portion 32*a* and the pair of hinge thin portions 32*b*, 32*c* of the first key unit 30, respectively. Each of the hinge thick portions 42*a* has a gate corresponding portion 42*a*1 in its upper surface at a substantially center position of a corresponding one of the white keys 41 in the right and left direction. This gate corresponding portion 42*a*1 is similar in construction to the gate corresponding portion 32*a*1 of the first key unit 30. The common mounting portion 43 is also substantially similar in construction to the common mounting portion 33 of the first key unit 30. The common mounting portion 43 includes a recessed portion 43*a*, a protruding portion 43*b*, the protrusion 43*c*, a through hole 43*d*, and through holes 43*e* which are similar to the recessed portion 33*a*, the protruding portion 33*b*, the protrusion 33*c*, the through hole 33*d*, and the through holes 33*e*, respectively.

In this second key unit 40, however, each of the hinge thick portions 42*a* is connected at its front end to a lower end portion of a rear surface of the rear wall of a corresponding one of the white keys 41, but each of the hinge thin portions 42*b*, 42*c* is connected at its front end to an upper end portion of a rear surface of a corresponding one of the hinge thick portions 42*a* and is connected at its rear end to a lower portion of a front surface of the common mounting portion 43. In a state in which the first and second key units 30, 40 are assembled to the key frame 10 and the electric circuit board 20, the hinge thick portion 42*a* and the hinge thick portion 32*a* of the first key unit 30 are located at the same height, and the common mounting portion 43 and the hinge thin portions 42*b*, 42*c* are located above the common mounting portion 33 and the hinge thin portions 32*b*, 32*c* of the first key unit 30. Each of the hinge thick portions 42*a* is spaced apart from an adjacent one of the hinge thick portions 32*a* of the first key unit 30 with a slight clearance therebetween in, the right and left direction (strictly, with a clearance which is slightly smaller than a clearance between adjacent two of the white keys 31, 41 in the right and left direction).

The length of the recessed portion 43*a* in the front and rear direction is substantially equal to that of the protruding portion 33*b* of the first key unit 30 in the front and rear direction. The protruding portion 33*b* of the first key unit 30 is fitted into the recessed portion 43*a* in a state in which the common mounting portion 43 of the second key unit 40 is assembled onto the common mounting portion 33 of the first key unit 30. The protrusion 43*c* is provided at a position opposed to the through hole 33*d* of the first key unit 30 in the right and left direction. The outside diameter of the protrusion 43*c* is substantially equal to the inside diameter of the through hole 33*d*. The protrusion 43*c* is pressed into the through hole 33*d* in the state in which the common mounting portion 43 of the second key unit 40 is assembled onto the common mounting portion 33 of the first key unit 30. The through hole 43*d* is formed in the common mounting portion 43. In the present embodiment, the through hole 43*d* is formed at an intermediate portion of the common mounting portion 43 in the right and left direction. The through hole 43*d* has a round shape. A protrusion 53*c*, which will be described below, provided on the third key unit 50 is pressed into the through hole 43*d* when the third key unit 50 is assembled onto the second key unit 40. The through holes 43*e* are formed in the common mounting portion 43 at positions corresponding to the respective supports 12 of the key frame 10 and the respective through holes 33*e* of the first key unit 30 in the right and left direction. When the first through third key units 30, 40, 50 are assembled to the key frame 10, the male screws, not shown, are inserted through the respective through holes 43*e*.

Figure 6A:
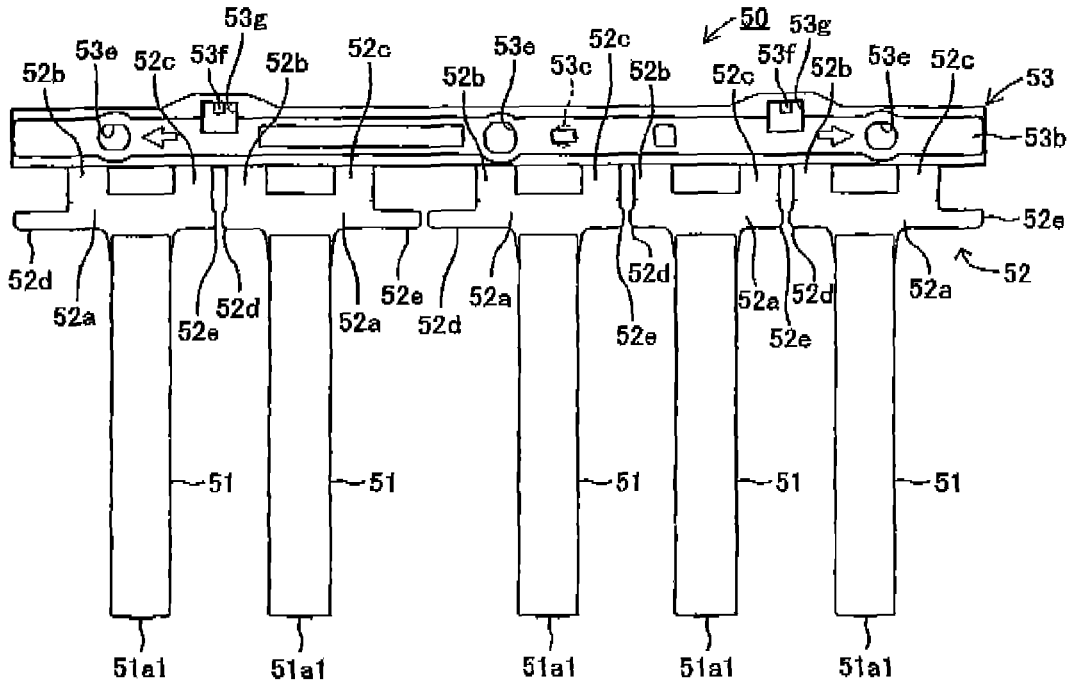
FIG. 6A is a plan view of a third key unit of the keyboard device in FIGS. 1 through 3B.
Figure 6B:
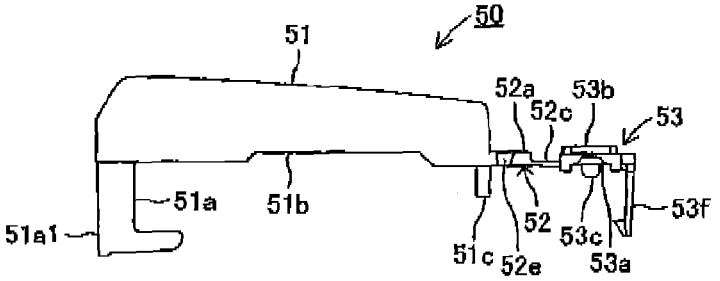
FIG. 6B is a side view of the third key unit.

There will be next explained the third key unit 50 with reference to FIGS. 6A and 6B. FIG. 6A is a plan view of the third key unit 50, and FIG. 6B is a side view thereof. The third key unit 50 includes the five black keys 51 not next (adjacent) to each other and respectively corresponding to notes C#, D#, F#, G#, and A#. Each of the black keys 51 is constituted by an upper plate, a front wall, right and left side walls, and a rear wall, which define a space opening downward and having a rectangular shape in cross section. The length of each black key 51 in the front and rear direction is less than that of each white key 31, 41 in the front and rear direction, and the height of each black key 51 is greater than that of each of the white keys 31, 41. An upper portion of the front wall of the black key 51 is inclined so as to be lower at its front end than at its rear end. An engaging piece 51*a* is provided on a front end of the lower surface of the black key 51, and this engaging piece 51*a* is similar to the engaging pieces 31*a*, 41*a* of the respective white keys 31, 41. A pressing portion 51*b* is provided on an intermediate position of the lower surface of the black key 51, and this pressing portion 51*h* is similar to the pressing portions 31*b*, 41*b* of the respective white keys 31, 41. The engaging piece 51*a* has a gate corresponding portion 51*a*1 at a lower portion (which does not form external appearance) of a front surface of the engaging piece 51*a*. This gate corresponding portion 51*a*1 is similar to the gate corresponding portions 32*a*1, 42*a*1 of the respective first and second key units 30, 40.

Each black key 51 is provided with a protruding piece 51*c* which extends downward from a lower surface of a rear end portion of the black key 51. This protruding piece 51*c* has a rectangular planar plate shape. The length of protruding piece 51*c* in the right and left direction is substantially equal to the width of the black key 51 in the right and left direction. In the state in which the first through third key units 30, 40, 50 are assembled to the key frame 10 and the electric circuit board 20, each of the protruding pieces 51*c* is positioned in a space defined in front of a corresponding pair of the hinge thick portions 32*a*, 42*a* of the respective first and second key units 30, 40 between corresponding adjacent two of the white keys 31, 41 other than the white keys 31, 41 respectively corresponding to E and F.

The rear walls of the respective five black keys 51 are connected to a common mounting portion 53 via respective hinges 52. The hinges 52 and the common mounting portion 53 are molded integrally with the black keys 51. Each of the hinges 52 is constituted by a hinge thick portion 52*a* and a pair of hinge thin portions 52*b*, 52*c* which are similar in construction to the hinge thick portions 32*a*, 42*a* and the pair of hinge thin portions 32*b*, 32*c*, 42*b*, 42*c* of the first and second key units 30, 40. The common mounting portion 53 is also substantially similar in construction to the common mounting portions 33, 43 of the respective first and second key units 30, 40. The common mounting portion 53 includes a recessed portion 53*a*, a protruding portion 53*b*, the protrusion 53*c*, and a through holes 53*e* which are similar to the recessed portions 33*a*, 43*a*, the protruding portions 33*b*, 43*b*, the protrusions 33*c*, 43*c*, and the through holes 33*e*, 43*e*, respectively.

In this third key unit 50, however, each of the hinge thick portions 52*a* is connected at its front end to a lower end portion of a rear surface of the rear wall of a corresponding one of the black keys 51, but each of the hinge thin portions 52*b*, 52*c* is connected at its front end to a lower end portion of a rear surface of a corresponding one of the hinge thick portions 52*a* and is connected at its rear end to a lower portion of a front surface of the common mounting portion 53. In the state in which the first through third key units 30, 40, 50 are assembled to the key frame 10 and the electric circuit board 20, the common mounting portion 53, the hinge thick portion 52*a*, and the hinge thin portions 52*b*, 52*c* of the third key unit 50 are respectively located above the common mounting portion 43, the hinge thick portion 42*a*, and the hinge thin portions 42*b*, 42*c* of the second key unit 40.

The shape of the hinge thick portion 52*a* is substantially the same as that of each of the hinge thick portions 32*a*, 42*a* of the respective first and second key units 30, 40. The thickness of the hinge thick portion 52*a* in the up and down direction is substantially equal to that of each of the hinge thick portions 32*a*, 42*a* of the respective first and second key units 30, 40 in the up and down direction. However, the length of the hinge thick portion 52*a* in the front and rear direction is extremely slightly less than that of each of the hinge thick portions 32*a*, 42*a* in the front and rear direction, and the length of the hinge thick portion 52*a* in the right and left direction is slightly greater than the length of each of the hinge thick portions 32*a*, 42*a* in the right and left direction. The center position of the hinge thick portion 52*a* in the right and left direction is the same as the center position of the black key 51 in the right and left direction. The shape of the hinge thin portions 52*b*, 52*c* is substantially the same as that of the hinge thin portions 32*b*, 32*c*, 42*b*, 42*c* of the first and second key units 30, 40. The thickness of each of the hinge thin portions 52*b*, 52*c* in the up and down direction and the length thereof in the front and rear direction are substantially equal to the thickness of each of the hinge thin portions 32*b*, 32*c*, 42*b*, 42*c* of the first and second key units 30, 40 in the up and down direction and the length thereof in the front and rear direction, respectively. However, the length of each of the hinge thin portions 52*b*, 52*c* in the right and left direction is slightly less than the length of each of the hinge thin portions 32*b*, 32*c*, 42*b*, 42*c* in the right and left direction. The hinge thin portions 52*b*, 52*c* are also arranged so as to be symmetric with respect to the center line of the black key 51 in the right and left direction. However, a distance between the hinge thin portions 52*b*, 52*c* is greater than each of a distance between the hinge thin portions 32*b*, 32*c* and a distance between the hinge thin portions 42*b*, 42*c*.

Protrusions (tabs) 52*d*, 52*e* are respectively provided on right and left ends of the hinge thick portion 52*a* so as to protrude in the right and left direction. Each of the protrusions 52*d*, 52*e* has a rectangular shape with a chamfered outer end. The thickness of each of the protrusions 52*d*, 52*e* in the up and down direction is equal to the thickness of the hinge thick portion 52*a* in the up and down direction, and the length of each of the protrusions 52*d*, 52*e* in the length of the front and rear direction is less than the length of the hinge thick portion 52*a* in the front and rear direction. These protrusions 52*d*, 52*e* are provided on a front portion of the hinge thick portion 52*a* such that front surfaces of the respective protrusions 52*d*, 52*e* are flush and integral with a front surface of the hinge thick portion 52*a*. Thus, rear surfaces of the respective protrusions 52*d*, 52*e* are located in front of a rear surface of the hinge thick portion 52*a*. The protrusions 52*d*, 52*e* of the plurality of black keys 51 have different lengths in the right and left direction. A slight clearance is formed between the protrusion 52*d* and the protrusion 52*e* of adjacent two of the black keys 51. Specifically, for each of the black keys 51 respectively corresponding to C# and F#, an amount of protrusion of the protrusion 52*d* in the left direction is large, and an amount of protrusion of the protrusion 52*e* in the right direction is small. For each of the black keys 51 respectively corresponding to D# and A#, an amount of protrusion of the protrusion 52*d* in the left direction is small, and an amount of protrusion of the protrusion 52*e* in the right direction is large. For the black key 51 corresponding to G#, an amount of protrusion of each of the protrusions 52*d*, 52*e* in the right and left direction is small.

Figure 7A:
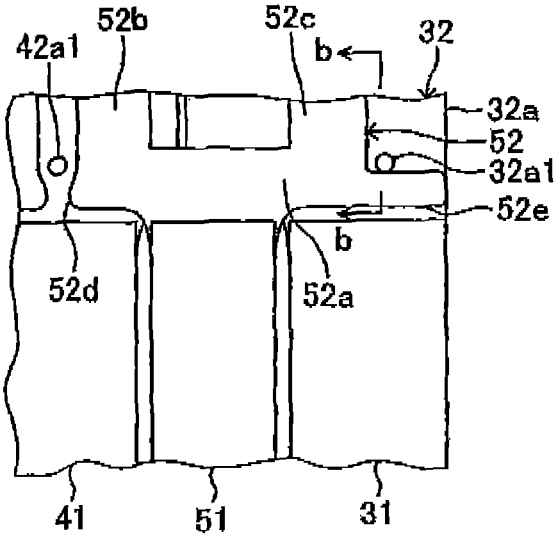
FIG. 7A is a partially enlarged plan view of FIG. 3A.
Figure 7B:
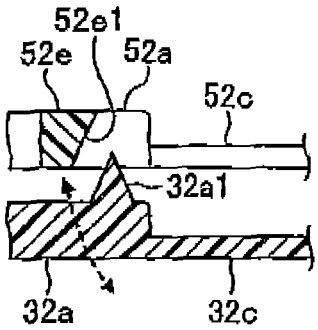
FIG. 7B is an enlarged cross-sectional view taken along line b-b in FIG. 7A.

These protrusions 52*d*, 52*e* will be further explained with reference to FIGS. 7A and 7B. FIG. 7A is an enlarged plan view of an area X indicated by the broken line in FIG. 3A, and FIG. 7B is an enlarged cross-sectional view taken along line b-b in FIG. 7A. It is noted that FIG. 7B illustrates a state in which a large gate mark is formed at the gate corresponding portion 32*a*1. Each of the rear surfaces 52*d*1, 52*e*1 of the respective protrusions 52*d*, 52*e* is inclined so as to be lower at its front portion than at its rear portion (noted that the rear surface 52*d*1 is not illustrated). That is, a lower end of each of the rear surfaces 52*d*1, 52*e*1 is located hi front of its upper end. This is for increasing the area of upper surfaces of the respective protrusions 52*d*, 52*e* to make it difficult for the player to view the hinge thick portions 32*a*, 42*a* of the first and second key units 30, 40 from an upper side thereof and for increasing the area of upper surfaces of rear portions of the respective hinge thick portions 32*a*, 42*a* which are not opposed to lower surfaces of the respective protrusions 52*d*, 52*e*.

The protrusions 52*d*, 52*e* are constructed as described above. Thus, in the state in which the first through third key units 30, 40, 50 are assembled to the key frame 10 and the electric circuit board 20, a space is formed, between a pair of the hinge thick portions 52*a*, 52*a* of each adjacent two of the black keys 51, over a portion of an upper surface of a rear portion of a corresponding one of the hinge thick portions 32*a*, 42*a* of the respective first and second key units 30, 40. Each of the gate corresponding portions 32*a*1, 42*a*1 is formed in the upper surface of a corresponding one of the hinge thick portions 32*a*, 42*a* which corresponds to the space. This construction is for avoiding contact between gate marks (e.g., protrusions) remaining on the gate corresponding portions 32*a*1, 42*a*1 and the lower surfaces of the respective protrusions 52*d*, 52*e* when each of the first and second key units 30, 40 is molded in one piece by injecting resin into a corresponding one of the gate corresponding portions 32*a*1, 42*a*1. When each of the black keys 51 is depressed and released, in particular, the hinge thick portion 52*a* corresponding to the black key 51 is pivoted as indicated by the broken-line arrows in FIG. 7B. If the gate mark is large, a rear end of the lower surface of each of the protrusions 52*d*, 52*e* may be brought into contact with the gate mark. As described above, however, since each of the rear surfaces 52*d*1, 52*e*1 of the respective protrusions 52*d*, 52*e* are inclined so as to be lower at its front portion than at its rear portion, it is possible to avoid a contact between the gate mark and the rear end of the lower surface of each of the protrusions 52*d*, 52*e*.

The length of the recessed portion 53*a* in the front and rear direction is substantially equal to that of the protruding portion 43*b* of the second key unit 40 in the front and rear direction. The protruding portion 43*b* of the second key unit 40 is fitted into the recessed portion 53*a* in a state in which the common mounting portion 53 of the third key unit 50 is assembled onto the common mounting portion 43 of the second key unit 40. The protrusion 53*c* is provided at a position opposed to the through hole 43*d* of the second key unit 40 in the right and left direction. The outside diameter of the protrusion 53*c* is substantially equal to the inside diameter of the through hole 43*d*. The protrusion 53*c* is pressed into the through hole 43*d* in the state in which the common mounting portion 53 of the third key unit 50 is assembled onto the common mounting portion 43 of the second key unit 40. The through holes 53*e* are formed in the common mounting portion 53 at positions corresponding to the respective supports 12 of the key frame 10, the respective through holes 33*e* of the first key unit 30, and the respective through holes 43*e* of the second key unit 40 in the right and left direction. When the first through third key units 30, 40, 50 are assembled to the key frame 10, the male screws, not shown, are inserted through the respective through holes 53*e*.

Hooks 53*f* extend downward from a lower surface of a rear end portion of the common mounting portion 53. The hooks 53*f* are spaced apart from each other in the right and left direction. In the present embodiment, the two hooks 53*f* are provided on an intermediate portion of the common mounting portion 53 in the right and left direction. A lower end portion of each of the hooks 53*f* has an engaging portion, in the form of an overhang, extending frontward and having a triangle shape in elevational cross section with its upper side made horizontal. When the first through third key units 30, 40, 50 are assembled to the electric circuit board 20, the engaging portions of the respective hooks 53*f* are engaged with a rear end portion of the lower surface of the electric circuit board 20. However, the engaging portions of the respective hooks 53*f* are not engaged or held in contact with the rear end portion of the lower surface of the electric circuit board 20 in a state in which the first through third key units 30, 40, 50 and the electric circuit board 20 are secured to the key frame 10 by screws, not shown. The common mounting portion 53 has rectangular through holes 53*g* extending therethrough in the up and down direction. These through holes 53*g* are formed at positions corresponding to the respective hooks 53*f* so as to be opposed to the upper surfaces of the respective engaging portions. These through holes 53*g* are formed in order to easily mold the engaging portions of the respective hooks 53*f* using a pair of upper and lower molds when the third key unit 50 is molded by resin in one piece.

There will be next explained assembly of the electric circuit board 20 and the first through third key units 30, 40, 50 to the key frame 10. The common mounting portion 43 of the second key unit 40 is placed onto the common mounting portion 33 of the first key unit 30 to assemble the second key unit 40 onto the first key unit 30. In this assembly, the protruding portion 33*b* of the common mounting portion 33 is fitted into the recessed portion 43*a* of the common mounting portion 43, and the protrusion 43*c* of the common mounting portion 43 is pressed into the through hole 33*d* of the common mounting portion 33. The common mounting portion 53 of the third key unit 50 is then placed onto the common mounting portion 43 of the second key unit 40 assembled onto the first key unit 30, to assemble the third key unit 50 onto the second key unit 40. In this assembly, the protruding portion 43*b* of the common mounting portion 43 is fitted into the recessed portion 53*a* of the common mounting portion 53, and the protrusion 53*c* of the common mounting portion 53 is pressed into the through hole 43*d* of the common mounting portion 43. As a result, a keyboard unit constituted by the first through third key units 30, 40, 50 is completed.

The electric circuit board 20 is then placed onto the supports 11, 12 such that through holes formed in a front portion of the electric circuit board 20 are aligned with the respective supports 11 of the key frame 10. The male screws, not shown, are then inserted into and engaged with the respective screw holes of the supports 11 from the upper surface of the electric circuit board 20, to assemble the electric circuit board 20 to the key frame 10. It is noted that the cushioning materials 14, 21 are in advance fixed respectively to the lowerlimit stopper 13 of the key frame 10 and the lower surface of the front end portion of the electric circuit board 20.

The keyboard unit constituted by the first through third key units 30, 40, 50 is then assembled to the electric circuit board 20. In this assembly, the protruding pieces 33*f* of the first key unit 30 are inserted through the respective through holes, not shown, formed in the electric circuit board 20 in a state in which the engaging pieces 31*a*, 41*a*, 51*a* of the white keys 31, 41 and the black keys 51 are engaged with the lower surface of the front end portion of the electric circuit board 20. Furthermore, the common mounting portion 33 of the first key unit 30 is placed onto the rear end portion of the electric circuit board 20 to engage the engaging portions of the respective hooks 53*f* of the third key unit 50 with the lower surface of the rear end portion of the electric circuit board 20. In this state, the through holes 33*e*, 43*e*, 53*e* formed in the common mounting portions 33, 43, 53 of the first through third key units 30, 40, 50 and the through holes, not shown, formed in the electric circuit board 20 are substantially opposed to the respective screw holes formed in the supports 12 of the key frame 10. The male screws, not shown, are inserted through the through holes 33*e*, 43*e*, 53*e* and the through holes of the electric circuit board 20 from an upper side thereof and further inserted into and engaged with the respective screw holes formed in the supports 12. It is noted that, as illustrated in FIG. 3, the plurality of hinges 32, 42, 52 of the first through third key units 30, 40, 50 are arranged such that respective plate surfaces of the hinge thick portions and the hinge thin portions of the plurality of hinges 32, 42, 52 are substantially horizontal in the state in which the keyboard unit constituted by the first through third key units 30, 40, 50 is assembled to the key frame 10. That is, the respective plate surfaces of the plurality of hinges 32, 42, 52 may be horizontal and may be inclined with respect to a horizontal plane.

The upper cover 15 is then connected to joints, not shown, of the key frame 10 to cover a rear portion of the third key unit 50. As a result, the keyboard unit constituted by the first through third key units 30, 40, 50 is assembled onto the key frame 10 and the electric circuit board 20, and the keyboard device is completed. In this state, a front surface of the upper cover 15 is located over the front portions of the respective hinge thick portions 52*a* of the third key unit 50 and the protrusions 52*d*, 52*e*, and a slight clearance is formed between the front surface of the upper cover 15 and the rear end surfaces of the white keys 31, 41 and the black keys 51.

In the keyboard device completed as described above, when depressed by the player, each of the white keys 31, 41 and the black keys 51 is swung about the common mounting portions 33, 43, 53 by elastic deformation of the hinge thin portions 32*b*, 32*c*, 42*b*, 42*c*, 52*b*, 52*c*, such that the front end portion of each key is moved downward. When the lower surface of each of the respective engaging pieces 31*a*, 41*a*, 51*a* of the white keys 31, 41 and the black keys 51 is brought into contact with the upper surface of the cushioning material 14, the swing of a corresponding one of the white keys 31, 41 and the black keys 51 is stopped. When the depressed one of the white keys 31, 41 and the black keys 51 is released, the front end portion of the key is moved upward by resilience forces of the corresponding hinge thin portions 32*b*, 32*c*, 42*b*, 42*c*, 52*b*, 52*c* and a corresponding one of the key switches (e.g., rubber dome switches), not shown. When the upper surface of the protrusion of each of the engaging pieces 31*a*, 41*a*, 51*a* of the white keys 31, 41 and the black keys 51 is brought into contact with a lower surface of the cushioning material 21, a corresponding one of the white keys 31, 41 and the black keys 51 is returned to its original position, that is, a released key state is established again.

When each of the white keys 31, 41 and the black keys 51 is depressed and released as described above, a corresponding one of the pressing portions 31*b*, 41*b*, 51*b* turns on and off the corresponding key switch, not shown, provided on the electric circuit board 20. Turning each of the key switches on and off is used for control of production of a musical sound signal corresponding to the corresponding one of the white keys 31, 41 and the black keys 51 which is depressed and released.

In the keyboard device constructed and operated as described above, the protrusions 52*d*, 52*e* protruding outward are provided on the respective right and left outer ends of the hinge thick portion 52*a* of the third key unit 50 having the uppermost common mounting portion 53, and adjacent two of the protrusions 52*d*, 52*e* are spaced apart from each other with a small space therebetween in the right and left direction. With this construction, even in the case where the black keys 51 are next to each other at different distances, a space formed near a rear side of the black keys 51 between each adjacent two of the black keys 51 can be made extremely small regardless of the hinge thick portions 52*a*. As a result, the hinges 32, 42 of the first and second key units 30, 40 having the respective common mounting portions 33, 43 arranged under the uppermost common mounting portion 53 can be made inconspicuous when viewed from an upper side, resulting in good external appearance in a state in which the upper cover 15 covers a space formed behind positions located slightly at the rear of the respective rear ends of the white keys 31, 41 and the black keys 51.

In the plurality of hinges 32, 42 of the first and second key units 30, 40, the hinge thick portions 32*a*, 42*a* have substantially the same thickness in the up and down direction, substantially the same length in the front and rear direction, and substantially the same width in the right and left direction, and the pair of hinge thin portions 32*b*, 32*c*, 42*b*, 42*c* have substantially the same thickness in the up and down direction, substantially the same length in the front and rear direction, and substantially the same width in the right and left direction. Also, in the plurality of hinges 32, 42, the center position of each of the hinge thick portions 32*a*, 42*a* in the right and left direction is aligned with the center position of the front portion of a corresponding one of the white keys 31, 41 in the right and left direction, and each pair of hinge thin portions 32*b*, 32*e*, 42*b*, 42*c* are arranged so as to be symmetric with respect to the center line of the front portion of a corresponding one of the white keys 31, 41 in the right and left direction. This construction can eliminate variations, in stiffness (elasticity) of the hinge thin portions 32*b*, 32*c*, 42*b*, 42*c* and the hinge thick portions 32*a*, 42*a* in the right and left direction, between the white keys 31, 41 and between portions of each of the white keys 31, 41 in the right and left direction. As a result, the same key touch feeling can be provided for the white keys 31, 41 during depression and release thereof, and it is possible to eliminate an imbalance in each of the white keys 31, 41 in the right and left direction, resulting in increased key touch feeling. The elimination of the imbalance in the right and left direction can also eliminate twists of the hinge thin portions 32*b*, 32*c*, 42*b*, 42*c* and the hinge thick portions 32*a*, 42*a*, resulting in improved durability.

Likewise, in the plurality of hinges 52 of the third key unit 50, the hinge thick portions 52*a* have substantially the same thickness in the up and down direction, substantially the same length in the front and rear direction, and substantially the same width in the right and left direction, and the pair of hinge thin portions 52*b*, 52*c* have substantially the same thickness in the up and down direction, substantially the same length in the front and rear direction, and substantially the same width in the right and left direction. Also, in the plurality of hinges 52, the center position of each of the hinge thick portions 52*a* in the right and left direction is substantially aligned with the center position of a corresponding one of the black key 51 in the right and left direction, and each pair of hinge thin portions 52*b*, 52*c* are arranged so as to be substantially symmetric with respect to the center line of a corresponding one of the black keys 51 in the right and left direction. This construction can eliminate variations, in stiffness (elasticity) of the hinge thin portions 52*b*, 52*c* and the hinge thick portion 52*a* in the right and left direction, between the black keys 51 and between portions of each of the black keys 51 in the right and left direction. As a result, the same key touch feeling can be provided for the black keys 51 during depression and release thereof, and it is possible to eliminate an imbalance in each of the black keys 51 in the right and left direction, resulting in increased key touch feeling. The elimination of the imbalance in the right and left direction can also eliminate twists of the hinge thin portions 52*b*, 52*c* and the hinge thick portion 52*a*, resulting in improved durability.

It is noted that the width of each of the above-described plurality of hinge thick portions 52*a* in the right and left direction means the width of each of the hinge thick portions 52*a* which does not include the width of each of the protrusions 52*d*, 52*e* in the right and left direction. Specifically, the width of each of the plurality of hinge thick portions 52*a* in the right and left direction can be considered to mean a distance (width) between the left end and the right end of the hinge thick portion 52*a* in the right and left direction in, each of the plurality of hinges 52 in a state in which the position of the left end of the left hinge thin portion 52*b* is aligned with the position of the left end of the hinge thick portion 52*a*, and the position of the right end of the right hinge thin portion 52*c* is aligned with the position of the right end of the hinge thick portion 52*a* in each of the plurality of hinges 52. In other words, the width of each of the plurality of hinge thick portions 52*a* in the right and left direction can also be considered to be a distance (width) in the right and left direction between the left end of the left hinge thin portion 52*b* connected to the hinge thick portion 52*a* and the right end of the right hinge thin portion 52*c* connected to the hinge thick portion 52*a*.

Likewise, the center position of each of the above-described plurality of hinges 52 in the right and left direction means the center position of each of the hinge thick portions 52*a* not including the protrusions 52*d*, 52*e* in the right and left direction. Specifically, the center position of each of the plurality of hinge thick portions 52*a* in the right and left direction can be considered to mean a center position between the left end and the right end of the hinge thick portion 52*a* in the right and left direction in each of the plurality of hinges 52 in the state in which the position of the left end of the left hinge thin portion 52*b* is aligned with the position of the left end of the hinge thick portion 52*a*, and the position of the right end of the right hinge thin portion 52*c* is aligned with the position of the right end of the hinge thick portion 52*a* in each of the plurality of hinges 52. In other words, the center position of each of the plurality of hinge thick portions 52*a* in the right and left direction can also be considered to be a center position in the right and left direction between the left end of the left hinge thin portion 52*b* connected to the hinge thick portion 52*a* and the right end of the right hinge thin portion 52*c* connected to the hinge thick portion 52*a*.

In the above-described embodiment, the common mounting portion 53 of the third key unit 50 including the black keys 51 is disposed at the uppermost position among the common mounting portions 33, 43, 53, and the protrusions 52*d*, 52*e* are provided on the right and left ends of the hinge thick portion 52*a*, whereby the hinge thick portions 32*a*, 42*a* of the respective first and second key units 30, 40 including the white keys 31, 41 are not easily viewed from an upper side thereof. In this construction, the hinge thick portions 32*a*, 42*a* are white like the white keys 31, 41, and the hinge thick portions 52*a* and the protrusions 52*d*, 52*e* are black like the black keys 51. Since the lower components are thus hidden by the black components, the hinge thick portions 32*a*, 42*a* as the lower components are not easily viewed, and the lower components can be hidden effectively when compared with the case where the common mounting portion 33 of the first key unit 30 or the common mounting portion 43 of the second key unit 40 is disposed at the uppermost position among the common mounting portions 33, 43, 53, and white protrusions each having the same shape as that of a corresponding one of the protrusions 52*d*, 52*e* are provided on the right and left ends of the hinge thick portion 32*a* or the binge thick portion 42*a*.

In the above-described embodiment, the length of each of the protrusions 52*d*, 52*e* in the uppermost third key unit 50 in the front and rear direction is less than that of the hinge thick portion 52*a* in the front and rear direction, and the rear surfaces of the respective protrusions 52*d*, 52*e* are located in front of the rear surface of the hinge thick portion 52*a*. The space is formed, between the pair of the hinge thick portions 52*a*, 52*a* of each adjacent two of the black keys 51, over the portion of the upper surface of the rear portion of the corresponding one of the hinge thick portions 32*a*, 42*a* of the respective first and second key units 30, 40. Furthermore, the gate corresponding portions 32*a*1, 42*a*1 used for molding the respective first and second key units 30, 40 are formed in the upper surfaces of the rear portions of the respective hinge thick portions 32*a*, 42*a*. With this construction, when each of the first and second key units 30, 40 is molded in one piece by injecting resin into a corresponding one of the gate corresponding portions 32*a*1, 42*a*1, the lower surfaces of the respective protrusions 52*d*, 52*e* is never brought into contact with the gate marks (e.g., protrusions) remaining on the gate corresponding portions 32*a*1, 42*a*1. In molding of the first and second key units 30, 40, resin can be evenly and smoothly poured into the white keys 31, 41 and the common mounting portions 33, 43, whereby each of the first and second key units 30, 40 can be well molded in one piece without weld lines, for example.

In particular, each of the rear surfaces 52*d*1, 52*e*1 of the respective protrusions 52*d*, 52*e* is inclined so as to be lower at its front portion than at its rear portion, and accordingly even when a rear end of the upper surface of each of the protrusions 52*d*, 52*e* is disposed at a relatively rear position, the rear end of the lower surface of each of the protrusions 52*d*, 52*e* is not brought into contact with the gate mark during depression and release of each black key 51. This construction allows increase in the lengths of the upper surfaces of the respective protrusions 52*d*, 52*e* in the front and rear direction, enabling the protrusions 52*d*, 52*e* to hide the lower components more effectively.

Each of the rear surfaces 52*d*1, 52*e*1 is inclined so as to be lower at its front portion than at its rear portion as described above, but the rear surfaces 52*d*1, 52*e*1 may be formed such that a rear end of a lower end of each of the rear surfaces 52*d*1, 52*e*1 is located in front of a rear end of an upper end of each of the rear surfaces 52*d*1, 52*e*1. In this case, each of the rear surfaces 52*d*1, 52*e*1 may be inclined and may be formed so as to have a step. Also, each of the rear surfaces 52*d*1, 52*e*1 may be curved so as to be recessed in the front direction.

It is to be understood that the disclosure is not limited to the details of the illustrated embodiment, but may be embodied with various changes and modifications, which may occur to those skilled in the art, without departing from the spirit and scope of the disclosure.

In the above-described embodiment, each pair of the hinge thin portions 32*b*, 32*c*, 42*b*, 42*c*, 52*b*, 52*c* are connected to the rear surfaces of the respective opposite outer end portions (i.e., right and left outer end portions) of the corresponding one of the hinge thick portions 32*a*, 42*a*, 52*a*. Instead of the hinge thin portions 32*b*, 32*c*, 42*b*, 42*c*, 52*b*, 52*c*, however, a single hinge thin portion may be provided for each of the keys 31, 41, 51 and connected to the rear surface of the corresponding one of the hinge thick portions 32*a*, 42*a*, 52*a*.

In the above-described embodiment, the protrusions 52*d*, 52*e* are provided on the right and left ends of the hinge thick portion 52*a* for all the black keys 51. Instead of this construction, however, the protrusion 52*d* or the protrusion 52*e* may be provided on only one of the right and left ends of the hinge thick portion 52*a* for each of the black keys 51 such that a small space is formed between the hinge thick portion 52*a* and the protrusion 52*d* or the protrusion 52*e* in the right and left direction in adjacent two of the black keys 51, in order to make the lower hinge thick portions 32*a*, 42*a* inconspicuous when viewed from an upper side thereof.

The clearances are not large between the hinge thick portions 52*a*, 52*a* of the black keys 51, 51 respectively corresponding to C# and D#, between the hinge thick portions 52*a*, 52*a* of the black keys 51, 51 respectively corresponding to F# and G#, and between the hinge thick portions 52*a*, 52*a* of the black keys 51, 51 respectively corresponding to G# and A#. Accordingly, the protrusion 52*e* located to the right of the black key 51 corresponding to C#, the protrusion 52*d* located to the left of the black key 51 corresponding to D#, the protrusion 52*e* located to the right of the black key 51 corresponding to F#, the protrusion 52*d* located to the left of the black key 51 corresponding to G#, the protrusion 52*e* located to the right of the black key 51 corresponding to G#, and the protrusion 52*d* located to the left of the black key 51 corresponding to A# may be omitted, and this omission is not problematic. In this construction, this keyboard device is preferably constructed such that the length of the hinge thick portion 52*a* in the right and left direction is made slightly greater, and the clearance between the hinge thick portions 52*a*, 52*a* in the right and left direction is made as small as possible.

In the above-described embodiment, the protrusions 52*d*, 52*e* and the hinge thick portion 52*a* have the same thickness in the up and down direction. Instead of this construction, however, the thickness of the protrusions 52*d*, 52*e* in the up and down direction may be less than that of the hinge thick portion 52*a* in the up and down direction. For example, the thickness of the protrusions 52*d*, 52*e* in the up and down direction may be substantially equal to that of the hinge thin portions 52*b*, 52*c* in the up and down direction.

In the above-described embodiment, the length of each of the protrusions 52*d*, 52*e* in the front and rear direction is less than the length of the hinge thick portion 52*a* in the front and rear direction, whereby the protrusions 52*d*, 52*e* do not overlap portions of the upper surfaces of the hinge thick portions 32*a*, 42*a* of the respective first and second key units 30, 40, and the gate corresponding portions 32*a*1, 42*a*1 are formed in the portions of the respective upper surfaces. However, the length of each of the protrusions 52*d*, 52*e* in the front and rear direction in the third key unit 50 having the uppermost common mounting portion 53 may be equal to the length of the hinge thick portion 52*a* in the front and rear direction as long as the problem of contact between the lower surfaces of the respective protrusions 52*d*, 52*e* and the gate marks (e.g., protrusions) remaining in the case where the first and second key units 30, 40 are molded by resin can be solved by another method, e.g., a method of molding the first and second key units 30, 40 by forming gate corresponding portions in other inconspicuous portions in terms of external appearance.

In the above-described embodiment, the shapes and the dimensional relationships of the hinge thick portions 32*a*, 42*a*, 52*a* and the hinge thin portions 32*b*, 32*c*, 42*b*, 42*c*, 52*b*, 52*c* of the first through third key units 30, 40, 50 are determined in detail. For example, the length of the hinge thick portion 52*a* of the third key unit 50 in the front and rear direction is extremely slightly less than the length of each of the hinge thick portions 32*a*, 42*a* of the respective first and second key units 30, 40 in the front and rear direction, and the length of the hinge thick portion 52*a* in the right and left direction is slightly greater than the length of each of the hinge thick portions 32*a*, 42*a* in the right and left direction. Also, the length of each of the hinge thin portions 52*b*, 52*c* of the third key unit 50 in the front and rear direction is substantially equal to the length of each of the hinge thin portions 32*b*, 32*c*, 42*b*, 42*c* of the first and second key units 30, 40 in the front and rear direction, and the length of each of the hinge thin portions 52*b*, 52*c* in the right and left direction is slightly less than the length of each of the hinge thin portions 32*b*, 32*c*, 42*b*, 42*c* in the right and left direction. However, the shapes and the dimensional relationships may be changed in some degree as needed.

In the above-described embodiment, the common mounting portion 53 of the third key unit 50 including the black keys 51 is placed on the common mounting portions 33, 43 of the respective first and second key units 30, 40 including the white keys 31, 41, such that the common mounting portion 53 is located at the uppermost position among the common mounting portions 33, 43, 53. However, the common mounting portion 33 (or the common mounting portion 43) of the first key unit 30 (or the second key unit 40) including the white keys 31 (or the white keys 41) is located at the uppermost position among the common mounting portions 33, 43, 53. In this construction, protrusions similar to the protrusions 52*d*, 52*e* are provided on right and left outer ends of the hinge thick portion 32*a* (or the hinge thick portion 42*a*) of the first key unit 30 (or the second key unit 40). With this construction, these protrusions allow the hinge thin portions 32*b*, 32*c* (or the hinge thin portions 42*b*, 42*c*) and the hinge thick portion 32*a* (or the hinge thick portion 42*a*) to be arranged at desired positions with respect to the white keys 31 (or the white keys 41) in the right and left direction while ensuring good external appearance.

What is claimed is:

1. A keyboard device, comprising:

a plurality of key units each comprising a plurality of keys, a plurality of hinges, a common mounting portion which are molded in one piece, a plurality of the common mounting portions of the plurality of key units being superposed on each other and secured to a key frame, wherein the plurality of keys are arranged in a right and left direction and each extends in a front and rear direction, wherein the common mounting portion is elongated in the right and left direction, wherein each of the plurality of hinges is provided between the common mounting portion and a rear end of a corresponding one of the plurality of keys and has a planar plate shape in which a plate surface of each of the plurality of hinges is substantially horizontal, wherein the plurality of key units comprise a particular key unit comprising an uppermost common mounting portion of the plurality of the common mounting portions, wherein each of at least one of the plurality of hinges of the particular key unit comprises:

a hinge thick portion connected to a rear surface of a corresponding one of the plurality of keys; and a hinge thin portion connected to a rear surface of the hinge thick portion and connected to a front surface of the uppermost common mounting portion, the hinge thin portion being less in thickness than the hinge thick portion in an up and down direction, and wherein a protrusion protruding outward is provided on at least one of opposite outer ends of the hinge thick portion in the right and left direction.

2. The keyboard device according to claim 1, wherein the hinge thin portion is constituted by a pair of hinge thin portions connected to respective opposite outer ends of the rear surface of the hinge thick portion in the right and left direction.

3. The keyboard device according to claim 1, wherein in at least two of the plurality of hinges of the particular key unit, a plurality of the hinge thick portions have a substantially identical thickness in the up and down direction, a substantially identical length in the front and rear direction, and a substantially identical width in the right and left direction, and a plurality of the hinge thin portions have a substantially identical thickness in the up and down direction, a substantially identical length in the front and rear direction, and a substantially identical width in the right and left direction.

4. The keyboard device according to claim 1, wherein in each of at least one of the plurality of hinges of the particular key unit, a center position of the hinge thick portion in the right and left direction is substantially aligned with a center position of a corresponding one of the plurality of keys in the right and left direction, and the hinge thin portion is substantially symmetric with respect to a center line of the corresponding one of the plurality of keys in the right and left direction.

5. The keyboard device according to claim 1, wherein the plurality of key units comprise at least one key unit different from the particular key unit, and each of the at least one key unit comprises the common mounting portion under the uppermost common mounting portion, wherein in each of the at least one key unit, each of at least one of the plurality of hinges comprises:

a hinge thick portion connected to a rear surface of a corresponding one of the plurality of keys; and a hinge thin portion connected to a rear surface of the hinge thick portion and connected to a front surface of the common mounting portion, the hinge thin portion being less in thickness than the hinge thick portion in the up and down direction, wherein in each of at least one of the plurality of hinges of the particular key unit, a length of the protrusion in the front and rear direction is less than that of the hinge thick portion in the front and rear direction, and a rear end of the protrusion is located in front of a rear end of the hinge thick portion, and wherein in each of the at least one key unit different from the particular key unit, a portion of an upper surface of the hinge thick portion is located behind the protrusion.

6. The keyboard device according to claim 1, wherein, a rear surface of the protrusion is formed such that a rear end of a lower end of the protrusion is located in front of a rear end of an upper end of the protrusion.

7. The keyboard device according to claim 1, wherein in the particular key unit, each of the plurality of keys corresponds to a corresponding one of a note C#, a note D#, a note F#, a note G#, and a note A#, wherein the protrusion is not provided on a right end of the hinge thick portion of one of the plurality of keys which corresponds to the note C#, a left end of the hinge thick portion of one of the plurality of keys which corresponds to the note D#, a right end of the hinge thick portion of one of the plurality of keys which corresponds to the note F#, a left end and a right end of the hinge thick portion of one of the plurality of keys which corresponds to the note G#, and a left end of the hinge thick portion of one of the plurality of keys which corresponds to the note A#, and wherein the protrusion is provided only on a left end of the hinge thick portion of the one of the plurality of keys which corresponds to the note C#, a right end of the hinge thick portion of the one of the plurality of keys which corresponds to the note D#, a left end of the hinge thick portion of the one of the plurality of keys which corresponds to the note F#, and a right end of the hinge thick portion of the one of the plurality of keys which corresponds to the note A#.

8. The keyboard device according to claim 1, wherein a thickness of the protrusion in the up and down direction is less than that of the hinge thick portion in the up and down direction.

9. A key unit, comprising:

a plurality of keys arranged in a tight and left direction and each extending in a front and rear direction;

a common mounting portion elongated in the right and left direction; and a plurality of hinges each provided between the common mounting portion and a rear end of a corresponding one of the plurality of keys and having a planar plate shape in which a plate surface of each of the plurality of hinges is substantially horizontal, wherein each of at least one of the plurality of hinges comprises:

a hinge thick portion connected to a rear surface of a corresponding one of the plurality of keys; and a hinge thin portion connected to a rear surface of the hinge thick portion and connected to a front surface of the common mounting portion, the hinge thin portion being less in thickness than the hinge thick portion in an up and down direction, and wherein a protrusion protruding outward is provided on at least one of opposite outer ends of the hinge thick portion in the right and left direction.

10. The key unit according to claim 9, wherein the hinge thin portion is constituted by a pair of hinge thin portions connected to respective opposite outer ends of the rear surface of the hinge thick portion in the right and left direction.

11. The key unit according to claim 9, wherein in at least two of the plurality of hinges of the particular key unit, a plurality of the hinge thick portions have a substantially identical thickness in the up and down direction, a substantially identical length in the front and rear direction, and a substantially identical width in the right and left direction, and a plurality of the hinge thin portions have a substantially identical thickness in the up and down direction, a substantially identical length in the front and rear direction, and a substantially identical width in the right and left direction.

12. The key unit according to claim 9, wherein a center position of the hinge thick portion in the right and left direction, is substantially aligned with a center position of a corresponding one of the plurality of keys in the right and left direction, and the hinge thin portion is substantially symmetric with respect to a center line of the corresponding one of the plurality of keys in the right and left direction.

13. The key unit according to claim 9, wherein a length of the protrusion in the front and rear direction is less than that of the hinge thick portion in the front and rear direction, and a rear end of the protrusion is located in front of a rear end of the hinge thick portion.

14. The key unit according to claim 9, wherein a rear surface of the protrusion is inclined such that a rear end of a lower surface of the protrusion is located in front of a rear end of an upper surface of the protrusion.

15. The key unit according to claim 9, wherein each of the plurality of keys corresponds to a corresponding one of a note C#, a note D#, a note F#, a note G#, and a note A#, wherein the protrusion is not provided on a right end of the hinge thick portion of one of the plurality of keys which corresponds to the note C#, a left end of the hinge thick portion of one of the plurality of keys which corresponds to the note D#, a right end of the hinge thick portion of one of the plurality of keys which corresponds to the note F#, a left end and a right end of the hinge thick portion of one of the plurality of keys which corresponds to the note G#, and a left end of the hinge thick portion of one of the plurality of keys which corresponds to the note A#, and wherein the protrusion is provided only on a left end of the hinge thick portion of the one of the plurality of keys which corresponds to the note C#, a right end of the hinge thick portion of the one of the plurality of keys which corresponds to the note D#, a left end of the hinge thick portion of the one of the plurality of keys which corresponds to the note F#, and a right end of the hinge thick portion of the one of the plurality of keys which corresponds to the note A#.

16. The key unit according to claim 9, wherein a thickness of the protrusion in the up and down direction, is less than that of the hinge thick portion in the up and down direction.

* * * * *